US005645196A

United States Patent [19]

Hancuff

[11] Patent Number: 5,645,196

[45] Date of Patent: Jul. 8, 1997

[54] LIQUID DRINK CARTON HOLDER

[76] Inventor: Charles O. Hancuff, 1729 Cypress Point Glen, Escondido, Calif. 92026

[21] Appl. No.: 515,396

[22] Filed: Aug. 15, 1995

[51] Int. Cl.[6] ..... A47G 19/14

[52] U.S. Cl. ..... 222/183; 222/25; 222/158; 222/465.1; 73/426; 116/216; 215/396; 220/737; 294/27.1; 294/167; 374/150

[58] Field of Search ..... 222/158, 183, 222/465.1, 469, 25; 294/27.1, 31.2, 30, 32, 33, 167; 215/395, 396; 220/737, 739, 741; 116/216, 227; 73/426, 427; 374/141, 150, 161

[56] References Cited

U.S. PATENT DOCUMENTS

| | | | |
|---|---|---|---|
| D. 167,214 | 7/1952 | Lapin | 222/465.1 X |
| 2,428,588 | 10/1947 | Schroeder et al. | 222/465.1 X |
| 2,640,628 | 6/1953 | Klosky | 222/158 |
| 2,782,064 | 2/1957 | Montgomery | 294/31.2 |
| 2,810,503 | 10/1957 | Krueger | 215/395 X |
| 2,843,302 | 7/1958 | Bandy | 220/737 |
| 2,936,927 | 5/1960 | Peters | 222/465.1 X |
| 2,999,714 | 9/1961 | Ritchie | 294/167 X |
| 3,265,250 | 8/1966 | Meyer | 215/396 X |
| 3,373,897 | 3/1968 | Haines | 220/737 |
| 3,864,976 | 2/1975 | Parker | 116/216 X |
| 4,974,741 | 12/1990 | Gustafson et al. | 215/395 X |
| 5,141,134 | 8/1992 | Machado | 222/465.1 X |
| 5,454,487 | 10/1995 | Vassiliou | 222/158 X |

FOREIGN PATENT DOCUMENTS

| | | | |
|---|---|---|---|
| 516719 | 4/1960 | Canada | 220/737 |

*Primary Examiner*—Kevin P. Shaver
*Attorney, Agent, or Firm*—John R. Duncan; Frank D. Gilliam

[57] ABSTRACT

A holder for standard liquid filled cartons, such as those containing milk or juice. The holder includes a sleeve that surrounds the carton sides, a base closing the sleeve for supporting the bottom of a carton and a handle for lifting and carrying the holder and carton and for pouring liquid from the carton. The handle preferably is movable between a deployed position for use and a stored position folded against the holder. The holder may also be used as a measuring vessel when a carton is not housed therein. A second set of indica may be provided on the sleeve indicating the volume at different levels in the holder without a carton therein. Also, a thermometer, preferably a liquid crystal temperature indicating strip, may be provided on the inside of a transparent sleeve to show the temperature of a container therein.

6 Claims, 1 Drawing Sheet

LIQUID DRINK CARTON HOLDER

BACKGROUND OF THE INVENTION

This invention relates in general to devices for holding a carton of the sort used for milk, fruit juices and the like. More specifically, the invention involves a handled holder for enclosing the sides and bottom of a liquid drink carton.

Milk and other drinks, such as fruit juices, are generally sold in plastic or wax coated paper cartons of standard sizes, e.g., quart, half-gallon, etc. A closed spout arrangement at the top is bent and torn open to allow pouring of the liquid from the carton.

While economical, disposable and generally easy to use, these cartons have a number of problems. The cartons are prone to leakage with even slightly rough handling. When stored in a refrigerator in a vehicle such as a boat, travel trailer or motor home, leakage often results from holes formed by the carton vibrating against refrigerator shelves or other items in the refrigerator. Since the sides are quite flexible, when the carton has been opened and only a small amount of its contents used, grasping the carton to pick it up often results in compression of the sides to the point where liquid is spilled out of the spout.

A number of milk carton holders have bee designed in attempts to overcome these leakage and spillage problems. Short holders configured to receive particular carton sizes are described by Kesselman in U.S. Pat. No. 2,868,411 and Stevenson in U.S. Pat. 2,944,700. These holders have walls that cover approximately half of the carton wall height and have small pedestals at the interior bottom corners to elevate the carton above a central bottom cavity. If the carton should happen to leak, milk is collected in that cavity. However, if the leak is significant and the carton nearly full, the cavity will be filled and milk will flow over the top of the holder. Further, the pedestals support only very small areas of the carton bottom, which is not particularly sturdy and is designed to be supported on a continuous flat surface. The carton bottom may bulge at the center and be pierced by the pedestal edges, resulting in a serious leak.

Olson, in U.S. Pat. No. 2,600,911, describes a milk carton holder having walls surrounding somewhat over half the carton sides and an open bottom, with two opposed lugs extending slightly inwardly of the walls at the bottom of the holder to support the carton bottom. Knurled areas are provided on the outer walls to aid in gripping the holder, which is primarily intended to prevent collapse of the carton walls when firmly gripped. This holder does not retain any leaks and the small bottom lugs are likely to damage the carton bottom, causing severe leaks.

A milk carton holder having a series of openings along the side to aid in observing the liquid level and to act as finger gripping means and a heavy weight in the bottom to limit tipping is disclosed by Baumgartner in U.S. Pat. No. 2,932,423. This holder will be difficult for children and persons with hand problems of the sort that result from arthritis will have problems with the weight of this holder and the need to grasp the holder sides. In addition, the side holes prevent the holder from containing leakage or condensation which often occurs when a cold carton is used in a humid atmosphere.

Thus, there is a continuing need for improved liquid drink carton holders having improved convenience, can be more easily handled by children or those with hand strength problems, that will fully contain leaks and surface condensation, and that have utility beyond simply housing a carton.

SUMMARY OF THE INVENTION

The above noted problems, and others, are overcome in accordance with this invention basically by a carton holder for liquid drink cartons such as those that contain milk, fruit juices and the like that include a tubular sleeve for snugly receiving a carton and for covering the sides of a carton up to a position closely adjacent to a carton pouring spout, a base closing the bottom of the sleeve to retain any leakage and a handle on the side of the sleeve for easy lifting of the assembly of carton and holder and pouring liquid from the carton.

To increase the utility of the carton holder, liquid quantity indicia are preferably included on at least one sleeve surface indicating quantities of liquid in the holder when a carton is not in place. While most homes have measuring spoons or cups, few have a convenient way of measuring quantities greater than one cup, up to one-half gallon.

Any suitable handle may be attached to the sleeve. Generally, a broad, vertical shallow square-shaped handle is preferred as easiest for a child or person with weak or painful hands to lift. For best results, the handle connects to the sleeve at the very top and is only deep enough to fit the fingers comfortably between sleeve and the outer portion of the handle. Preferably, the handle portions extending outwardly of the sleeve are short, straight end generally perpendicular to the sleeve side. The handle cross piece is preferably straight and approximately parallel to the sleeve side.

In order to significantly reduce the refrigerator space occupied by the holder and handle, preferably the handle is foldable about a vertical axis so as to be moveable between an outwardly projecting lifting or use position and a folded or storage position flat against a sleeve wall. For best results, a means for releasably latching the handle in either the use or stored position is included. Any suitable releasable latch may be used, such as a simple plastic detent arrangement having a projection on one part of the handle cooperating with detents at the use and storage position. A spring loaded ball and detent system may also be used. A slidable bolt on the movable handle portion could cooperate with two openings on the fixed handle portion, if desired.

In hot weather, leaving a milk carton out of the refrigerator for an extended period or storing in an inadequate cooler or refrigerator can adversely affect the milk. In a preferred embodiment, the sleeve and bottom can be made from a thermally insulating material, optimally a high strength closed cell foam material. Further, a thermometer is preferably included along the sleeve to indicate the temperature of the liquid contents. While the thermometer may be placed at any suitable location, under the handle is preferred for ease of manufacture with the handle. Preferably, a liquid crystal temperature measuring strip, which has areas that change color at f=different indicated temperatures is used for simplicity, effectiveness and resistance to damage. Optimally, with a substantially transparent sleeve the strip can be recessed on an inner surface of the sleeve, so that it be in contact with the housed carton and will be somewhat thermally insulated from the outside temperature.

With the four sides and bottom of the carton, the carton will be thermally insulated and will remain much cooler when out of the refrigerator. Most plastics are thermally insulating, and the small dead area region between carton and container further improves thermal insulation. The container can be formed from a sturdy closed cell foam material, or may have a layer of foam on the exterior of a solid-walled container to further enhance this insulating affect.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
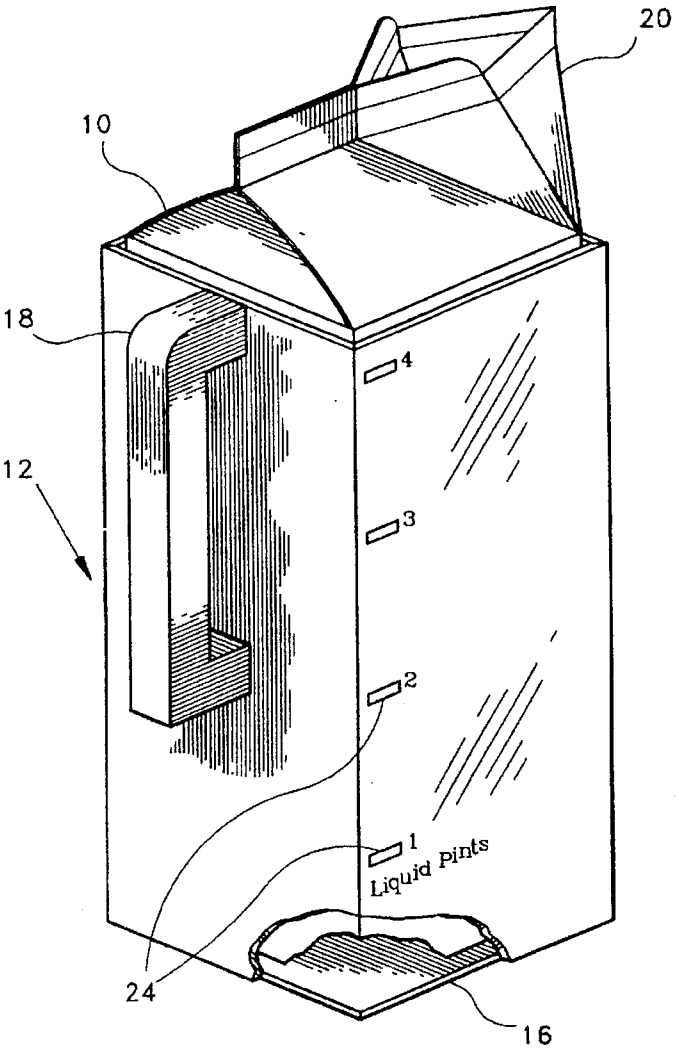
FIG. 1 is a perspective view of the combined carton holder and liquid measuring container.

Referring to FIG. 1, there is seen a conventional liquid drink carton 10 of the sort in which milk, fruit juices, etc. are sold. The holder 12 of this invention basically includes a tubular sleeve 14, a bottom 16 (seen in the cut-away area) closing the bottom end of sleeve 14 and uniformly supporting the bottom of carton 10 and a handle 18 secured to the side of sleeve 14.

Holder 12 may be manufactured in any suitable manner from any suitable material. Plastics such as acrylics, olefins, and polycarbonates give excellent results and are preferred. Typically, holder 12 could be formed by gluing up rectangular sheets of plastic material, or by extrusion of sleeve 14 and gluing or thermal welding bottom 16 thereto, or by injection molding techniques. Preferably, at least one wall of sleeve 14 is transparent or highly light transmissive translucent to allow the contents to be observed.

Holder 12 may have any suitable dimensions. Conventional quart milk and juice cartons have about 2⅞ inch square bases, while the bases of half gallon cartons are about 4 inches square. Preferably, the internal dimensions of sleeve 14 will be about 1/16 to 3/16 greater in each dimension to allow the carton to be easily slipped into the holder. Since the walls of the cartons are flexible, when they contain a significant quantity of liquid they will bulge into tight contact with the inner walls of sleeve 14, so that the carton will not slip out should the carton be tipped past horizontal. Once the liquid is used, the bulge will be gone so that the carton can be easily removed.

The thermal insulating qualities of typical plastics will prevent or limit condensation on the exterior holder surfaces when the holder and carton are removed from a refrigerator into a humid environment. Any condensation forming on the exposed top of carton 10 will tend to run down into the slight space between carton sand sleeve and be captured. Any leakage of carton contents will be similarly captured. Holder 12 should extend up the sides of carton 12 to the full extent of the sidewalls of the carton, as shown. If a leak should occur, the space between carton and holder may fill, but leakage cannot flow over the top of the sleeve 14, since the upper edge of sleeve 14 will almost always be above the surface of liquid in carton 10. Typical quart cartons have sidewall heights of about 7½ inches with corresponding heights for half gallon cartons is about 7¾ inches. The corresponding holders will have sleeves of these lengths, possibly plus a little more, ending just below the position of spout 20 on the carton.

Handle 18 may be formed from any suitable material and may have any suitable dimensions. Generally, a wide square- or rounded-cornered handle is preferred for ease of use and stability in lifting the combined carton and holder and pouring liquid from the carton. The space between handle and sleeve should be only sufficient to permit comfortable insertion of the fingers and holding the handle. Optimally, the handle portions extending outwardly of the sleeve side are straight and approximately perpendicular to the sleeve side. The cross piece 19 between those portions is preferably straight and approximately parallel to the sleeve side. The corners between outwardly extending portions and cross piece 19 are ideally approximately square.

With this configuration, a child or person with arthritis or similar conditions can easily lift, carry and pour from a carton. In fact, the container and carton can be lifted with a single finger through the handle and will balance satisfactorily. A handle that extends well away from the sleeve or has very rounded corners is much more difficult to lift and carry.

Preferably, handle 18 is made from the same material as sleeve 14. Handle 18 may be formed with sleeve 14 and bottom 18 if the holder is formed by injection molding or similar processes. Alternatively, handle 18 may be molded separately or cut from stock fastened to sleeve 14 by adhesive bonding, thermal welding or any equivalent process.

In order to increase the utility of holder 12, liquid quantity indicia showing quantities of liquid that can be accommodated when a carton is not in the container are provided along the exterior surface of sleeve 14. A set 24 of indicia may be provided on sleeve 14 showing quantities for liquid levels, such as pints, without a carton 10 in the container. This makes holder 12 eminently useful as a measuring container for relatively large quantities.

The set 24 of indica may be formed in any suitable manner at any suitable locations around sleeve 14. Where holder 12 is formed by injection molding or any equivalent process, the indicia may be formed as raised ridges or depressed grooves. Where holder is assembled from components and sleeve 14 is either assembled or extruded, indica set 24 could be pressed or engraved on the surface of sleeve 14 or, preferably, would be printed thereon using conventional printing processes.

Figure 2:
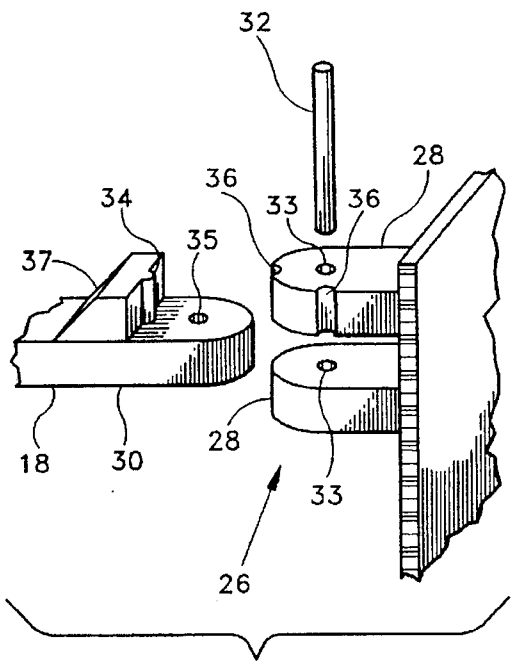
FIG. 2 is a detail perspective view of part of a foldable handle showing a latching mechanism.

A preferred handle arrangement is schematically shown in FIGS. 2. While a handle 18 of the sort shown in FIG. 1 is sturdy and simple, it occupies considerable refrigerator space and does not fit well against other packages. As seen in FIG. 2, a handle 18 can include hinges 26 to permit the handle to be folded flat against sleeve 14 when stored. Any suitable hinge may be used, with that shown being simple and effective. Each hinge 26 includes two brackets 28 bonded to, or formed integral with, sleeve 14. A handle end 30 extends in a mating relationship between brackets 28. A hinge pin 32 extends through holes 33 in brackets 28 and hole 35 in end 30 to allow handle 18 to move between a deployed position for use and a folded position for storage. Pin 32 may be a tight, press, fit in brackets 28, may be adhesively bonded thereto or may be in the form of a conventional bolt or rivet.

Figure 3:
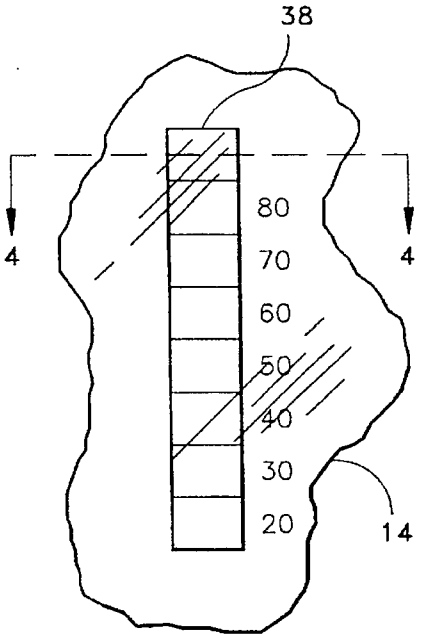
FIG. 3 is an elevation view of a temperature measuring strip on the holder.
Figure 4:
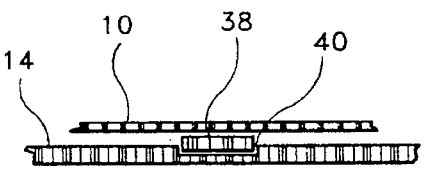
FIG. 4 is a section view taken on line 5—5 in FIG. 4.

While the handle and hinge arrangement is useful with a simple hinge, in particular where there is sufficient friction between extension 30 and brackets 28 to allow movement without looseness, preferably the handle is releasably latchable in the deployed and storage positions. Any suitable releasable latch may be used. For simplicity and effectiveness, a detent system including a small, elongated, rounded projection 34 on block 37 mounted on, or formed integrally with, end 30 and two cooperating elongated detents 36 in bracket 28 will hold the handle sufficiently in either position while allowing movement between the positions. If desired, projection 34 may be a metal ball and spring in a cavity in end 30, spring loaded toward the detents. This arrangement, while more complex, will result in less wear of the projection and detents.

Where a carton of milk or juice is left out of the refrigerator for a period, it is important that the liquid not become too warm. In order to assure that the liquid is maintained at a suitable temperature, and to reveal when that temperature has been exceeded, a thermometer is preferably included with holder 12. A particularly preferred arrangement is shown in FIGS. 4 and 5. A strip 38 of conventional liquid crystal temperature indicating material is placed on the inner surface of sleeve 14, so as to be in contact with carton 10 and thermally insulated by sleeve 14 from ambient temperatures. Where the strip 38 has appreciable thickness, it may be desired to form a shallow recess 40 on the inner surface of sleeve 14 to hold the strip.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A combined carton holder and liquid measuring container which comprises:

a rectangular tubular sleeve sized to slidingly receive and frictionally engage a conventional flexible-walled carton for liquids;

an end closure sealingly closing one end of said sleeve for substantially uniformly supporting a bottom surface of said carton;

a handle on an external surface of said sleeve and extending outwardly of said sleeve for lifting said sleeve and pouring liquid from a carton housed in said sleeve;

said handle being rectangular with substantially straight portions extending out from the sleeve and with a substantially straight cross piece extending approximately parallel to the sleeve, said cross piece being closely adjacent to said sleeve leaving room to insert fingers between sleeve and cross piece;

hinge means on said handle so that said handle can be moved between a storage position flat against said sleeve and a deployed position extending approximately perpendicular to said sleeve;

latch means at said hinge means for latching said handle in said deployed and storage positions; and indicia along at least one sleeve surface indicating quantity of liquid in said holder when said holder is filled to different levels.

2. The combined carton holder and liquid measuring container according to claim 1 wherein said sleeve is formed from rigid plastic foam material.

3. The combined carton holder and liquid measuring container according to claim 1 wherein said sleeve has a length sufficient to cover sides of a standard carton.

4. A combined carton holder and liquid measuring container which comprises:

a rectangular tubular sleeve sized to slidingly receive and frictionally engage a conventional flexible-walled carton for liquids;

said sleeve formed from an at least partially transparent material;

an end closure sealingly closing one end of said sleeve for substantially uniformly supporting a bottom surface of said carton;

a handle on an external surface of said sleeve and extending outwardly of said sleeve for lifting said sleeve and pouring liquid from a carton housed in said sleeve;

said handle being rectangular with substantially straight portions extending out from the sleeve and with a substantially straight cross piece extending approximately parallel to the sleeve, said cross piece being closely adjacent to said sleeve leaving room to insert fingers between sleeve and cross piece;

hinge means for mounting said handle on said sleeve so that said handle can be moved between a storage position flat against said sleeve and a deployed position extending approximately perpendicular to said sleeve;

said hinge means including latch means for latching said handle in said storage and deployed positions;

thermometer means mounted on an inside surface of said sleeve and visible from outside said sleeve for indicating temperature of the contents of contents of a carton in said holder; and a set of indicia on at least one sleeve surface indicating quantities corresponding to different liquid levels in said holder when a carton is not in place in said holder.

5. The combined carton holder and liquid measuring container according to claim 4 wherein said sleeve is formed from rigid plastic foam material.

6. The combined carton holder and liquid measuring container according to claim 4 wherein said sleeve has a length sufficient to cover sides of a standard carton.

* * * * *